US006829905B2

(12) United States Patent
Ohta et al.

(10) Patent No.: US 6,829,905 B2
(45) **Date of Patent: *Dec. 14, 2004**

(54) EJECTOR CYCLE AND ARRANGEMENT STRUCTURE THEREOF IN VEHICLE

(75) Inventors: Hiromi Ohta, Okazaki (JP); Masayuki Takeuchi, Nukata-gun (JP); Motohiro Yamaguchi, Hoi-gun (JP)

(73) Assignee: Denso Corporation, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/666,167

(22) Filed: Sep. 19, 2003

(65) Prior Publication Data

US 2004/0055327 A1 Mar. 25, 2004

(30) Foreign Application Priority Data

Sep. 20, 2002 (JP) ..... 2002-275681

(51) Int. Cl.[7] ..... F25D 23/06; F25B 1/06
(52) U.S. Cl. ..... 62/500; 62/239
(58) Field of Search ..... 62/500, 239

(56) References Cited

U.S. PATENT DOCUMENTS 6,044,655 A * 4/2000 Ozaki et al. ..... 62/205
6,550,265 B2 * 4/2003 Takeuchi et al. ..... 62/324.2

FOREIGN PATENT DOCUMENTS

JP 5-149652 6/1993

* cited by examiner

*Primary Examiner*—Denise L. Esquivel
*Assistant Examiner*—Filip Zec
(74) *Attorney, Agent, or Firm*—Harness, Dickey & Pierce, PLC

(57) ABSTRACT

In an ejector cycle having an ejector, a throttle is provided inside a passenger compartment adjacent to an evaporator so that a length of a refrigerant passage between the throttle and the evaporator is shortened. Therefore, it can restrict a part of liquid refrigerant after being decompressed in the throttle from being evaporated in the refrigerant passage, before being introduced into the evaporator. In addition, a refrigerant inlet is provided at a lower header tank of an evaporator. Therefore, a gas-liquid refrigerant distribution difference due to the density difference between gas refrigerant and liquid refrigerant can be effectively restricted. Thus, refrigerant distributed into the plural tubes from the lower header tank can be made uniform, even if the refrigerant flow speed is low in the ejector cycle.

12 Claims, 8 Drawing Sheets

FIG. 6

| EVAPORATOR CONDITION | THROTTLE IS POSITIONED IN ENGINE COMPARTMENT | | | | THROTTLE IS POSITIONED IN VICINITY OF EVAPORATOR | | | |
|---|---|---|---|---|---|---|---|---|
| | BLOWER INLET TEMPERATURE: 35.1°C EVAPORATOR PRESSURE: 4.7MPa | | | | BLOWER INLET TEMPERATURE: 29.2°C EVAPORATOR PRESSURE: 4.8MPa | | | |
| BLOWN AIR TEMPERATURE | PASSENGER'S SEAT SIDE | PASSENGER'S SEAT CENTER | DRIVER'S SEAT CENTER | DRIVER'S SEAT SIDE | PASSENGER'S SEAT SIDE | PASSENGER'S SEAT CENTER | DRIVER'S SEAT CENTER | DRIVER'S SEAT SIDE |
| | 21.1°C | 19.2°C | 17.7°C | 17.9°C | 15.2°C | 14.6°C | 14.0°C | 15.5°C |
| POST-EVAPORATOR AIR TEMPERATURE | 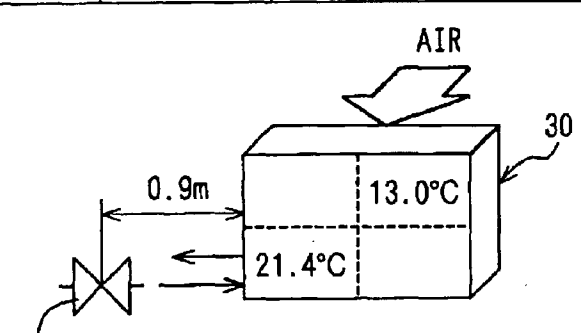  | | | | 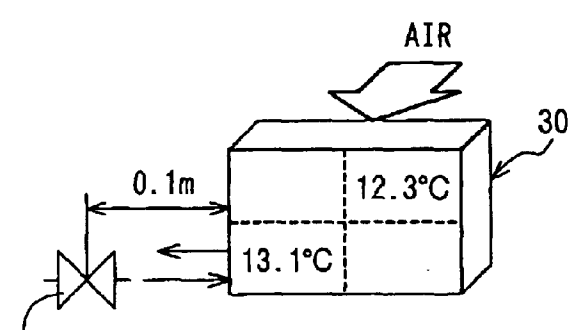  | | | |

EJECTOR CYCLE AND ARRANGEMENT STRUCTURE THEREOF IN VEHICLE

CROSS REFERENCE TO RELATED APPLICATION

This application is based on Japanese Patent Application No. 2002-275681 filed on Sep. 20, 2002, the disclosure of which is incorporated herein by reference.

BACKGROUND OF THE INVENTION

1. Field of the Invention

The present invention relates to an ejector cycle (vapor-compression refrigerant cycle) having an ejector that is used as a decompression unit, and an arrangement structure of the ejector cycle in a vehicle.

2. Related Art

In a conventional ejector cycle described in JP-A-5-149652, low-pressure gas refrigerant in an evaporator is sucked into an ejector while high-pressure refrigerant is decompressed in a nozzle of the ejector, and pressure of refrigerant to be sucked into a compressor is increased in a pressure-increasing portion of the ejector. Therefore, liquid refrigerant in a gas-liquid separator is circulated to the evaporator by a pump operation of the ejector. In the ejector cycle, a throttle unit such as an orifice and a capillary tube is generally provided between the evaporator and the gas-liquid separator, for sufficiently reducing the pressure and the temperature of the refrigerant supplied to the evaporator. However, when a refrigerant passage length between the throttle and the evaporator is long, a part of refrigerant in the refrigerant passage may be evaporated by absorbing heat from outside before flowing into the evaporator. Thus, gas-liquid two-phase refrigerant is introduced into the evaporator, and a cooling capacity (heat-absorbing capacity) in the evaporator is decreased.

Furthermore, when the gas-liquid two-phase refrigerant is supplied into plural tubes extending vertically in an evaporator from an upper side thereof, high-density liquid refrigerant tends to flow into the plural tubes in the vicinity of its inlet, and gas refrigerant tends to flow into the plural tubes separated from the inlet. Thus, the surface temperature of the evaporator is different at different positions, and the temperature distribution of the evaporator is deteriorated.

SUMMARY OF THE INVENTION

In view of the above-described problems, it is an object of the present invention to provide an ejector cycle, which effectively improves a cooling capacity.

It is another object of the present invention to restrict a temperature distribution difference in an evaporator of the ejector cycle.

It is further another object of the present invention to provide a simple arrangement structure of the ejector cycle in a vehicle while improving the cooling capacity.

According to the present invention, an ejector cycle includes a compressor for compressing refrigerant, a high-pressure heat exchanger disposed outside of a compartment for radiating heat of high-pressure refrigerant discharged from the compressor, a low-pressure heat exchanger disposed in the compartment for evaporating low-pressure refrigerant after being decompressed, an ejector including a nozzle for decompressing and expanding high-pressure refrigerant flowing from the high-pressure heat exchanger, a gas-liquid separator for separating refrigerant discharged from the ejector into gas refrigerant and liquid refrigerant, and a throttle for decompressing refrigerant flowing from the gas-liquid separator into the low-pressure heat exchanger. The ejector sucks gas refrigerant evaporated in the low-pressure heat exchanger by using a refrigerant flow jetted from the nozzle, and increases a pressure of the refrigerant to be sucked to the compressor. In the ejector cycle, the throttle is provided in the compartment. Therefore, a length of a refrigerant passage from the throttle to the low-pressure heat exchanger can be made shorter. Thus, it can restrict a part of refrigerant from the throttle from being evaporated by absorbing heat from the atmosphere, before being introduced to the evaporator. As a result, cooling capacity of the low-pressure heat exchanger can be improved when the ejector cycle is used for an air conditioner. In addition, because it can restrict gas-liquid two-phase refrigerant from flowing into the low-pressure heat exchanger, a refrigerant distribution to be introduced to the low-pressure heat exchanger can be improved.

Further, when the ejector cycle is disposed in a vehicle, the low-pressure heat exchanger is disposed in a passenger compartment, and the gas-liquid separator and the ejector are disposed in an engine compartment. Even in this case, because the throttle is disposed in the passenger compartment adjacent to the evaporator, the refrigerant pipe length between the throttle and the low-pressure heat exchanger can be made shorter, so that cooling performance in the low-pressure heat exchanger can be improved.

Preferably, an additional heat exchanger is disposed to perform heat exchange between refrigerant flowing from the gas-liquid separator to the low-pressure heat exchanger and refrigerant to be sucked to the elector from the low-pressure heat exchanger. In this case, the throttle is disposed in a refrigerant passage through which liquid refrigerant is introduced from the gas-liquid separator to an inlet of the low-pressure heat exchanger, between an outlet of the additional heat exchanger and the inlet of the low-pressure heat exchanger. Therefore, the refrigerant to be introduced to the low-pressure heat exchanger can be cooled, and refrigerant approximately in one liquid phase state can be introduced to the low-pressure heat exchanger.

On the other hand, the low-pressure heat exchanger includes a plurality of tubes extending substantially vertically, an upper header tank connected to upper ends of the tubes to communicate with the tubes, and a lower header tank connected to lower ends of the tubes to communicate with the tubes. In this case, a refrigerant inlet is provided in the lower header tank. Therefore, refrigerant is introduced into the low-pressure heat exchanger upwardly through the refrigerant inlet. Accordingly, it can reduce a temperature difference in a surface of the low-pressure heat exchanger due to a density difference between gas refrigerant and liquid refrigerant.

BRIEF DESCRIPTION OF THE DRAWINGS

Other objects, features and advantages of the present invention will become more apparent from the following detailed description made with reference to the accompanying drawings, in which:

FIG. 6 is a view showing the effects of throttle positions in the ejector cycle, according to the first embodiment;

DETAILED DESCRIPTION OF THE PREFERRED EMBODIMENTS (First Embodiment)

Figure 1:
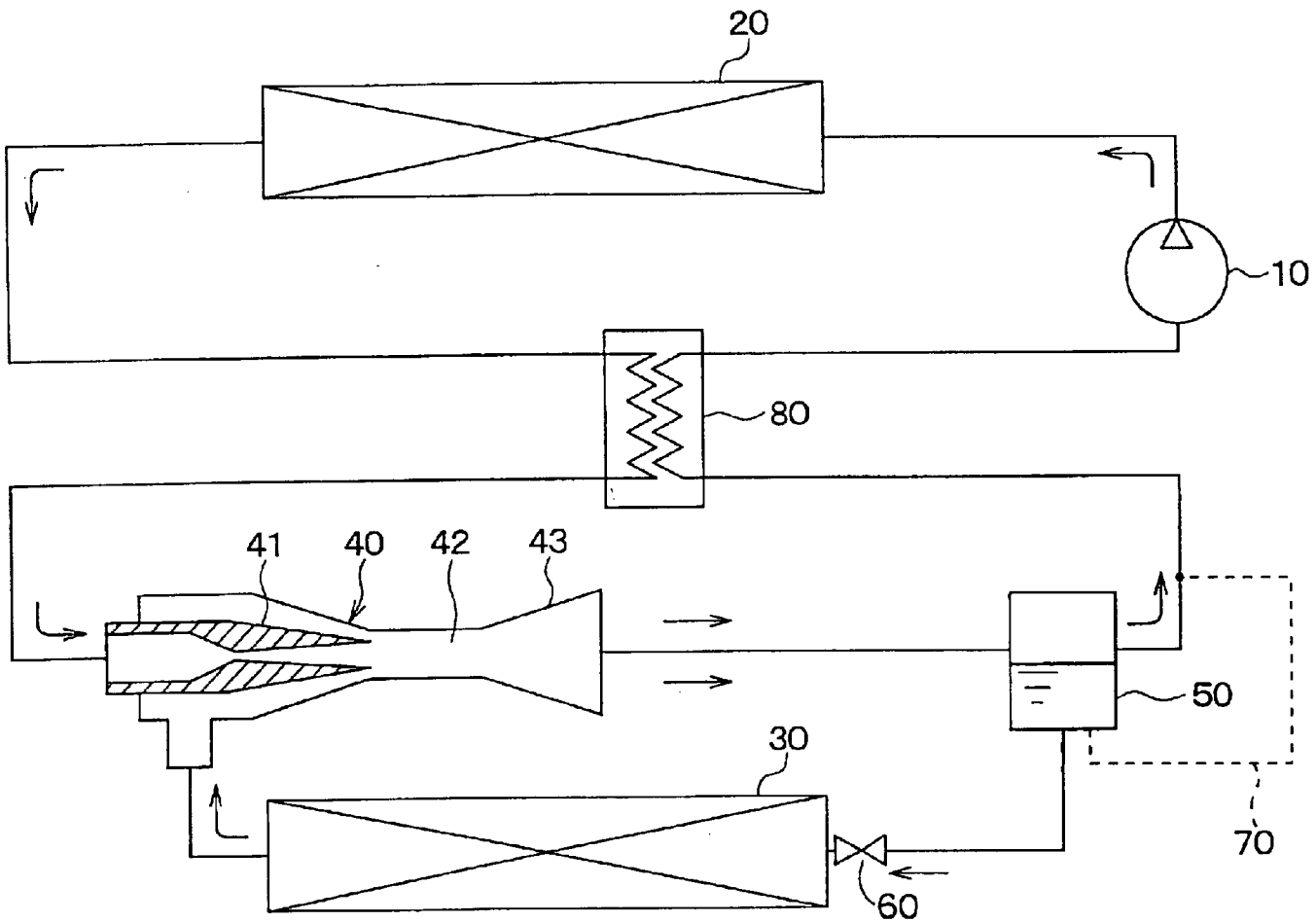
FIG. 1 is a schematic diagram showing an ejector cycle according to a first embodiment of the present invention.

In the first embodiment, an ejector cycle shown in FIG. 1 is typically used for a vehicle air conditioner. In the ejector cycle shown in FIG. 1, a compressor 10 is driven by an engine to compress refrigerant. A gas cooler 20 is a high-pressure side heat exchanger for performing heat-exchange between high-pressure refrigerant discharged from the compressor 10 and outside air so as to cool the high-pressure refrigerant. An evaporator 30 is a low-pressure side heat exchanger for cooling air to be blown into a passenger compartment by performing heat-exchange between air passing therethrough and low-pressure refrigerant after being decompressed. Low-pressure refrigerant is evaporated in the evaporator 30 by absorbing heat from air passing through the evaporator 30, so that air passing through the evaporator 30 is cooled.

Figure 3:
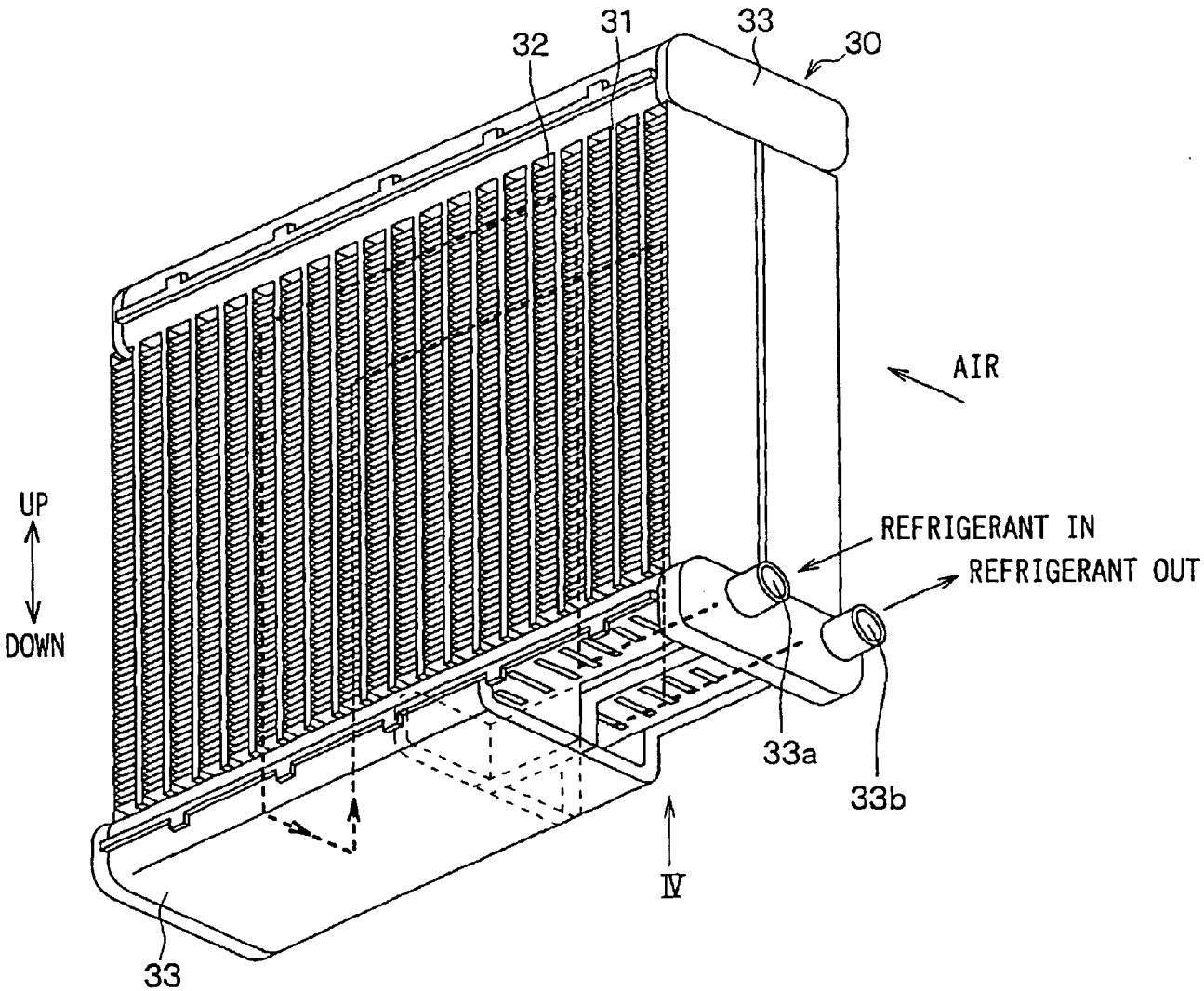
FIG. 3 is a schematic perspective view showing an evaporator according to the first embodiment.

As shown in FIG. 3, the evaporator 30 includes plural tubes 31 extending vertically, upper and lower header tanks 33 extending horizontally to communicate with the tubes 31. A core portion is constructed with the tubes 31, and fins 32 contacting outer surfaces of the tubes 31. The fins 32 are provided between the tubes 31, for accelerating heat-exchange performance between air and refrigerant. A refrigerant inlet 33*a* and a refrigerant outlet 33*b* are provided in the lower header tank 33 positioned on the lower side of the core portion. The tubes 31 are arranged two layers in an air flow direction to form upstream tubes 31 positioned upstream in the air flow direction, and downstream tubes 31 positioned downstream in the air flow direction. In this embodiment, refrigerant flowing into the evaporator 30 from the refrigerant inlet 33*a*, flows through the core portion from the downstream tubes 31 toward the upstream tubes 31, and flows out of the evaporator 30 from the refrigerant outlet 33*b*.

As shown in FIG. 1, an ejector 40 decompresses and expands refrigerant flowing from the gas cooler 20, and sucks gas refrigerant evaporated in the evaporator 30. The ejector 40 includes a nozzle 41, a mixing section 42 and a diffuser 43. The nozzle 41 transfers pressure energy of the high-pressure refrigerant into speed energy, and decompresses and expands the refrigerant isentropicly. The mixing section 42 mixes the high-speed refrigerant injected from the nozzle 41 and the gas refrigerant evaporated in the evaporator 30. The gas refrigerant evaporated in the evaporator 30 is sucked by entrainment function of the high-speed refrigerant injected from the nozzle 41. The diffuser 43 further mixes the refrigerant and transfers the speed energy of the mixed refrigerant into pressure energy so that the refrigerant pressure to be sucked into the compressor 10 is increased.

Here, a drive flow injected from the nozzle 41 and a suction flow from the evaporator 30 are mixed inside the mixing section 42 so that a momentum of the drive flow and a momentum of the suction flow are conserved. Therefore, static pressure of refrigerant is raised in the mixing section. Further, in the diffuser 43, the dynamic pressure of the refrigerant is transferred into the static pressure by gradually increasing cross-sectional area of the refrigerant passage inside the diffuser 43. Therefore, refrigerant pressure is increased in both of the mixing section 42 and the diffuser 43. Hence, the mixing section 42 and the diffuser 43 are generically named as a pressurizing section. A Laval nozzle is adopted as the nozzle 41 in this embodiment. The Laval nozzle has a most reduced throat in its passage to increase the injected refrigerant speed up to more than sound speed.

The gas-liquid separator 50 separates refrigerant from the ejector 40 into gas refrigerant and liquid refrigerant, and accumulates the liquid refrigerant therein. A gas refrigerant outlet of the gas-liquid separator 50 is connected to a suction port of the compressor 10, and a liquid refrigerant outlet of the gas-liquid separator 50 is connected to the evaporator 30.

Figure 4:
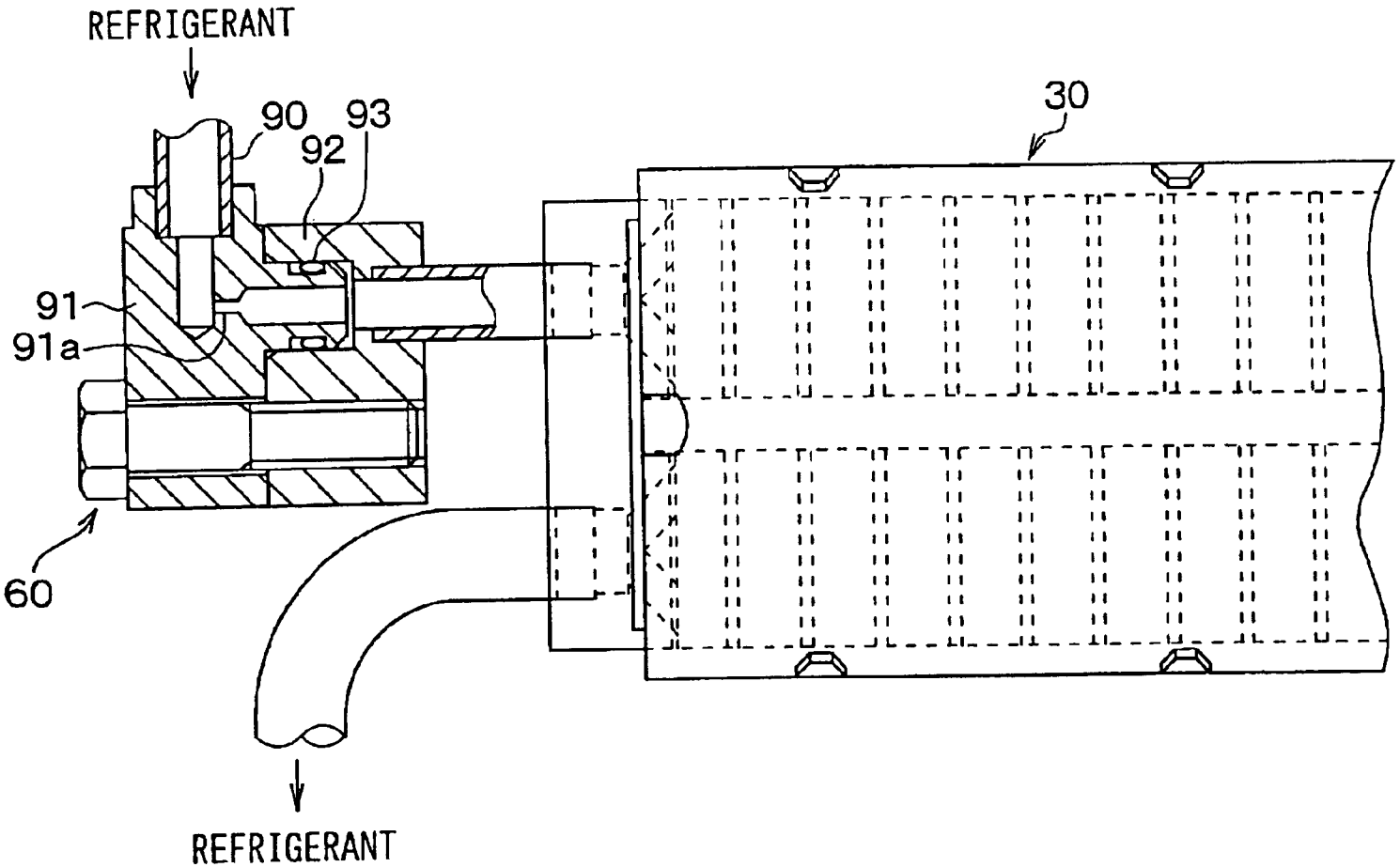
FIG. 4 is a bottom view when being viewed from the arrow IV in FIG. 3, according to the first embodiment.

A throttle 60 decompresses liquid refrigerant supplied from the gas-liquid separator 50 to the evaporator 30. As shown in FIG. 4, the throttle 60 is constructed of an orifice 91*a* provided in a joint block 91 (connection portion) for connecting the evaporator 30 and an interior refrigerant pipe 90. The interior refrigerant pipe 90 is provided in the passenger compartment, to be coupled to the gas-liquid separator 50 mounted in the engine compartment. The inner diameter of the orifice 91*a* is approximately 1.5 mm, and is approximately ¼ of the inner diameter of the refrigerant pipe 90, for example, in this embodiment. The throttle 60 is provided in a refrigerant path at a position near the evaporator 30 between the evaporator 30 and the gas-liquid separator 50, and is positioned in the passenger compartment. A joint block 92 adjacent to the evaporator 30 is brazed to the evaporator 30, and is joined to the joint block 91 of the interior refrigerant pipe 90. The joint block 91 and the joint block 92 are air-tightly connected to each other through an O-ring 93 by using a mechanical fastening member such as screws.

As shown in FIG. 1, an oil return passage 70 is provided for returning a lubrication oil separated in the gas-liquid separator 50 into the suction port of the compressor 10. An inner heat exchanger 80 performs heat-exchange between low-pressure refrigerant to be sucked into the compressor 10 and high-pressure refrigerant from the gas cooler 20.

Next, operation of the ejector cycle according to the first embodiment will be now described. In this embodiment, freon is used as the refrigerant. In this case, the pressure of high-pressure refrigerant discharged from the compressor 10 is lower than the critical pressure of the refrigerant. However, carbon dioxide can be used as the refrigerant. In this case, the pressure of high-pressure refrigerant discharged from the compressor 10 can be increased more than the critical pressure of the refrigerant.

When the compressor 10 starts its operation, gas refrigerant from the gas-liquid separator 50 is sucked into the compressor 10, and the compressed refrigerant is discharged toward the gas cooler 20. The refrigerant discharged from the compressor 10 is cooled in the gas cooler 20, and the cooled refrigerant is expanded in the nozzle 41 of the ejector 40. Refrigerant is sucked from the evaporator 30 to the mixing section 42 while refrigerant is jetted from the nozzle 41. The refrigerant sucked from the evaporator 30 and the refrigerant jetted from the nozzle 41 are mixed in the mixing section 42 and is expanded in the diffuser 43. Then, refrigerant is discharged from an outlet of the diffuser 43 of the ejector 40 into the gas-liquid separator 50.

On the other hand, because refrigerant in the evaporator 30 is sucked into the ejector 40, liquid refrigerant in the gas-liquid separator 50 is supplied into the evaporator 30 after passing through the throttle 60. The supplied refrigerant evaporates in the evaporator 30 by absorbing heat from air to be blown into the passenger compartment.

As shown in FIG. 3, the refrigerant inlet 33*a* is provided in the lower header tank 33. Therefore, refrigerant flows from the lower header tank 33 into the evaporator 30 upwardly, in this embodiment. Therefore, it is compared with a case where refrigerant flows from the upper refrigerant tank 33 into the evaporator 30 downwardly, the gas-liquid refrigerant distribution difference in the evaporator 30 due to the gravity difference between gas refrigerant and liquid refrigerant can be effectively restricted. Because refrigerant introduced into the lower header tank 33 from the refrigerant inlet 33*a* flows upwardly, it can restrict liquid refrigerant having relatively a large density from being readily introduced into the tubes 31 adjacent to the refrigerant inlet 33*a*, and gas refrigerant having relatively a small density from being readily introduced into the tubes 31 separated from the refrigerant inlet 33*a*. Thus, even if refrigerant flow speed from the gas-liquid separator 50 to the evaporator 30 is low in the ejector cycle, refrigerant can be uniformly distributed into the plural tubes 31 from the refrigerant inlet 33*a*, regardless its density difference between liquid refrigerant and gas refrigerant. As a result, in this embodiment, it can prevent high-density liquid refrigerant from mainly flowing into tubes 31 in vicinity of the refrigerant inlet 33*a* and low-density gas refrigerant from mainly flowing into tubes 31 separated from the refrigerant inlet 33*a*. Therefore, the surface temperature distribution of the evaporator 30 can be made uniform, and air temperature distribution can be made uniform.

In this ejector cycle, refrigerant is circulated from the gas-liquid separator 50 to the evaporator 30 by pumping operation of the ejector 40. Therefore, it is compared with a expansion valve cycle where a compressor directly circulates refrigerant to the evaporator 30, the amount of liquid refrigerant flowing into the evaporator 30 in this ejector cycle is larger. Therefore, refrigerant flow speed tends to be low in this ejector cycle, comparing with that of the expansion valve cycle. However, in the first embodiment, even when the refrigerant flow speed is low, the refrigerant distribution difference in the evaporator 30 and in an air temperature difference on the surface of the evaporator 30 can be can be made smaller.

Figure 5A:
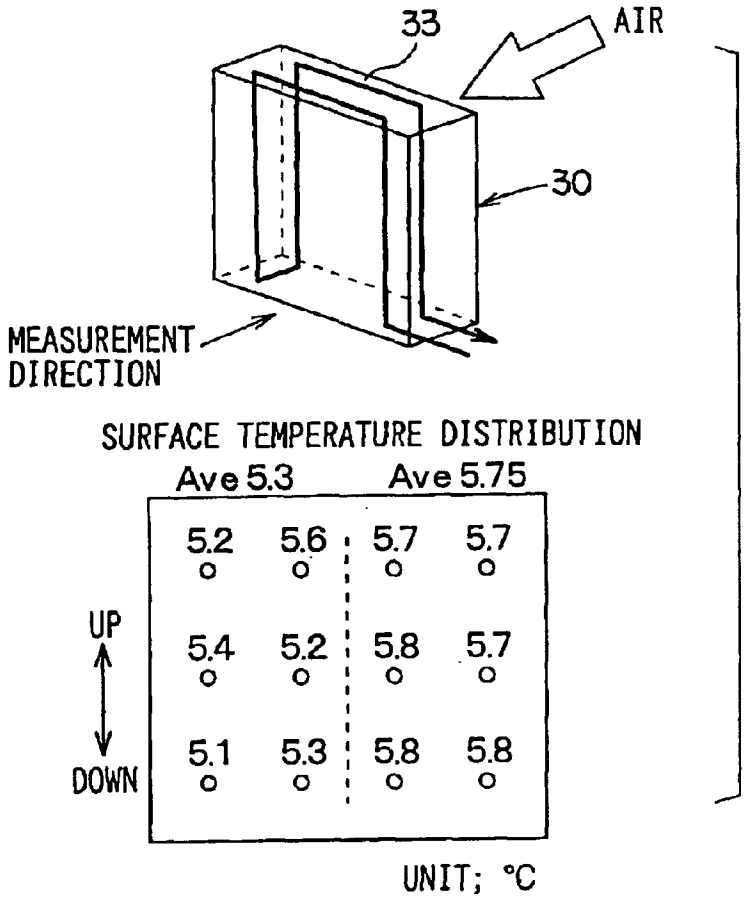
FIG. 5A is a schematic diagram for explaining a temperature distribution in an evaporator when an inlet and an outlet are provided at a lower side of the evaporator.
Figure 5B:
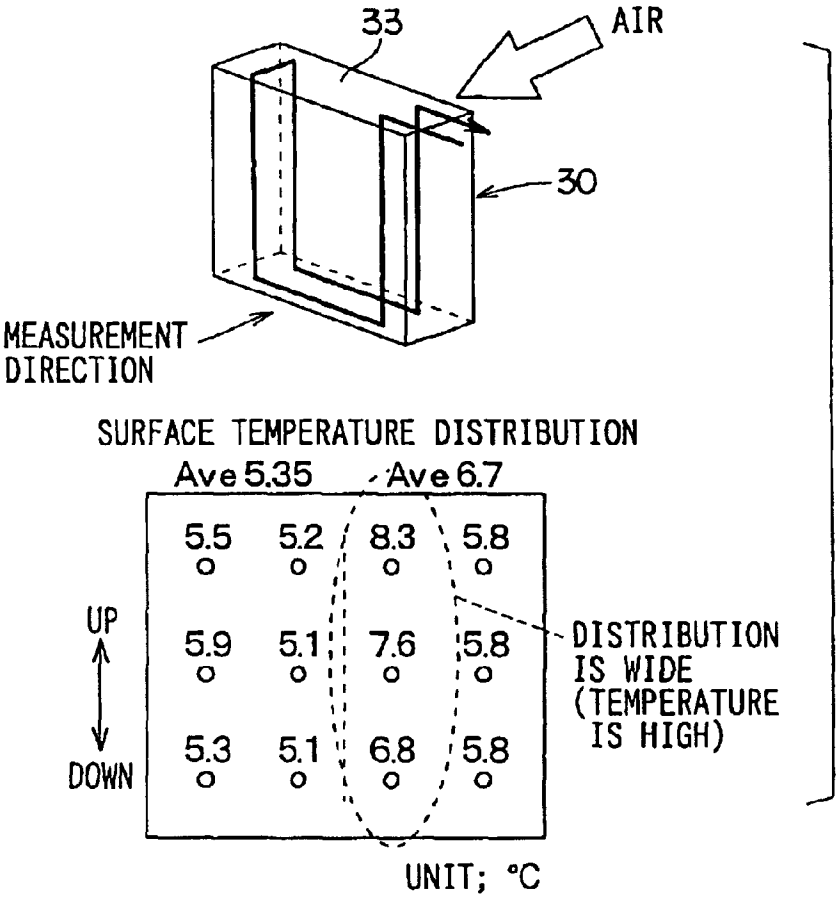
FIG. 5B is a schematic diagram for explaining a temperature distribution in an evaporator when an inlet and an outlet are provided at an upper side of the evaporator, according to the first embodiment.

FIG. 5B shows a test result of the temperature distribution on the surface of the evaporator 30 when refrigerant flows from the refrigerant inlet of the upper header tank 33 into the evaporator 30 downwardly. In this case, the evaporator 30 has a wide temperature distribution difference, in particular on the right side of the surface adjacent to the refrigerant inlet. In this case, the highest air temperature on the surface of the evaporator is about 8.3° C., and maximum temperature deviation is about 2° C. comparing with the average temperature of the left side surface 5.35° C. On the contrary, according to the present invention of FIG. 5A, temperature distribution difference is reduced when refrigerant flows from the refrigerant inlet 33*a* of the lower header tank 33 into the evaporator 30. As shown in FIG. 5A, the highest air temperature is about 5.8° C. on the surface, and maximum temperature deviation is less than 1° C. in the entire surface of the evaporator 30. Thus, the air temperature (i.e., post-evaporator air temperature) of the evaporator 30 can be made uniform in the structure of the evaporator 30 in the first embodiment. In the experiments of FIGS. 5A and 5B, the air temperature introduced into the evaporator 30 is 27° C., the relative humidity of air introduced into the evaporator 30 is 50% RH, the air flow to be blown into the evaporator 30 is 450 $m^3$/h, and the pressure of refrigerant flowing into the evaporator 30 from the refrigerant inlet 33*a* is 38.4 kgf/$cm^2$G (3.7 Mpa).

Figure 2:
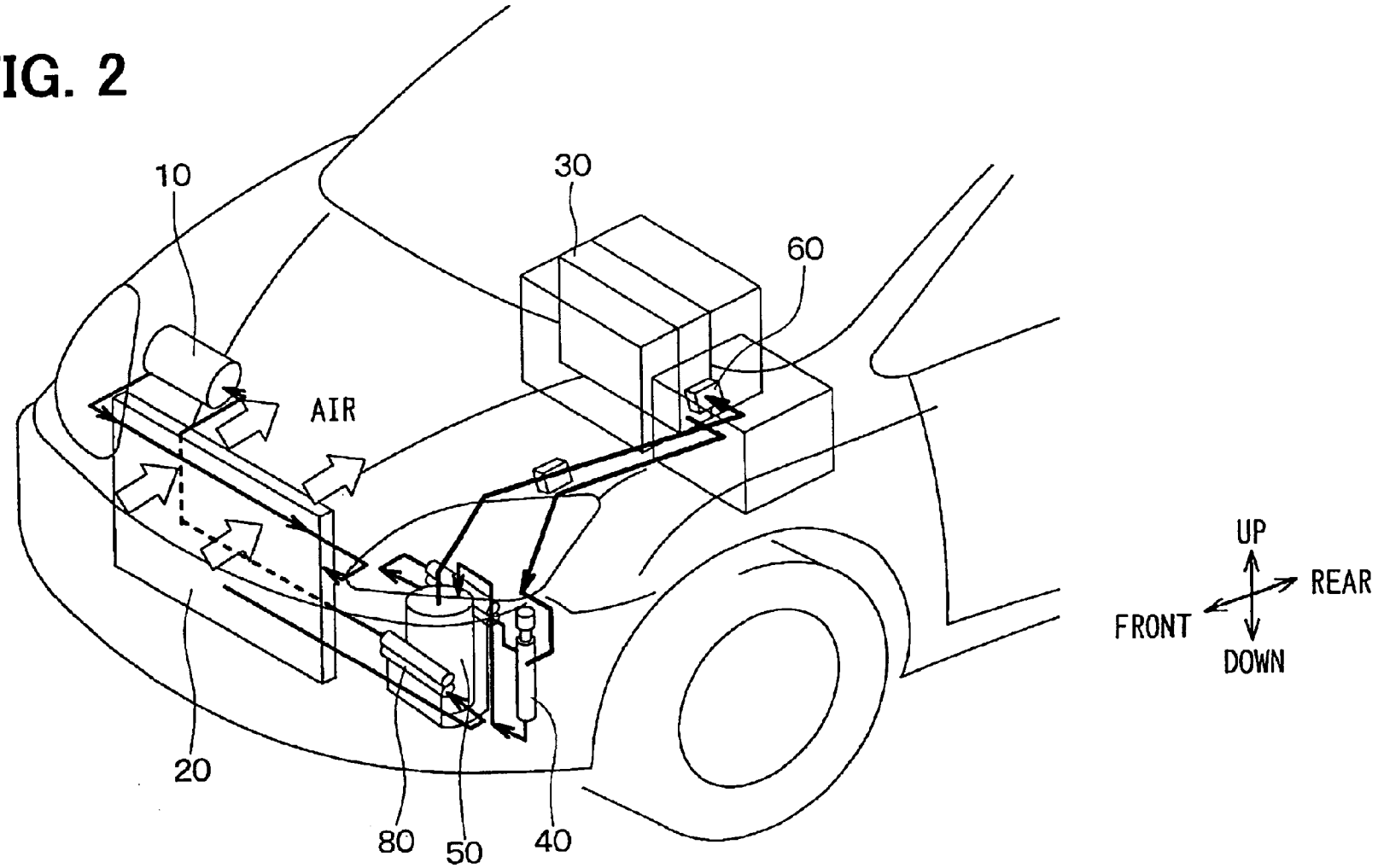
FIG. 2 is a schematic diagram showing an arrangement structure of the ejector cycle on a vehicle, according to the first embodiment.

As shown in FIG. 2, the throttle 60 is provided inside the passenger compartment so that refrigerant passage from the throttle 60 to the evaporator 30 is shortened. Therefore, it can restrict a part of liquid refrigerant from being evaporated before flowing into the evaporator 30 by absorbing heat from the atmosphere. Thus, a flow of gas-liquid two-phase refrigerant into the evaporator 30 can be avoided. Therefore, temperature deviation can be made small while cooling performance (heat-absorbing performance) of the evaporator 30 can be improved.

FIG. 6 shows a test result of a temperature distribution of air blown into different positions of the passenger compartment in a vehicle width direction, such as the center areas of the driver's and front-passenger's seats and the sides areas of the driver's and front-passenger's seats. Further, FIG. 6 shows a temperature distribution of air immediately after passing through the evaporator 30, when the throttle 60 is positioned in an engine compartment, and when the throttle 60 is positioned in the passenger compartment in the vicinity of the evaporator 30.

As shown in FIG. 6, when the throttle 60 is positioned in the engine compartment, the highest temperature of air blown into the passenger compartment is about 21.1° C. and the lowest temperature of air blown into the passenger compartment is about 17.7° C. In this case, maximum temperature deviation is about 3.4° C. On the contrary, when the throttle 60 is disposed adjacent to the evaporator 30 to be separated from the evaporator 30 by about 0.1 m, the highest temperature of air blown into the passenger compartment is about 15.5° C., and the lowest temperature of air blown into the passenger compartment is about 14.0° C. In this case, maximum temperature deviation is about 1.5° C. Thus, temperature deviation of air blown toward different positions of the passenger compartment can be effectively decreased by positioning the throttle 60 in the vicinity of the evaporator 30.

Further, as shown in FIG. 6, when the throttle 60 is provided in the engine compartment to be largely separated from the evaporator 30, the highest air temperature (post-evaporator air temperature) after passing through the evaporator 30 is about 21.4° C., and the lowest post-evaporator air temperature is about 13.0° C. In this case, temperature deviation of the post-evaporator air temperature is about 8.4° C. On the contrary, when the throttle 60 is provided around the evaporator 30, the highest post-evaporator air temperature is about 13.1° C., and the lowest post-evaporator air temperature is about 12.3° C. In this case, the temperature deviation of the post-evaporator air temperature is about 0.8° C. Accordingly, the temperature deviation in the post-evaporator air temperature can be effectively decreased by positioning the throttle 60 in the vicinity of the evaporator 30. In FIG. 6, the post-evaporator air temperature is detected by a thermistor.

According to experiments by the inventors of the present invention, when the throttle 60 is disposed adjacent to the evaporator 30 in a case where the refrigerant inlet 33*a* and the refrigerant outlet 33*b* are positioned in the upper header tank 33, the surface temperature distribution difference of the evaporator 30 can be reduced.

As shown in FIG. 4, the throttle 60 is constructed with the orifice 91*a* in a connection portion between an interior refrigerant pipe 90 and the evaporator 30. Therefore, surface temperature of the evaporator 30 can be uniformed without increase of the part number of the ejector cycle.

(Second Embodiment)

Figure 7:
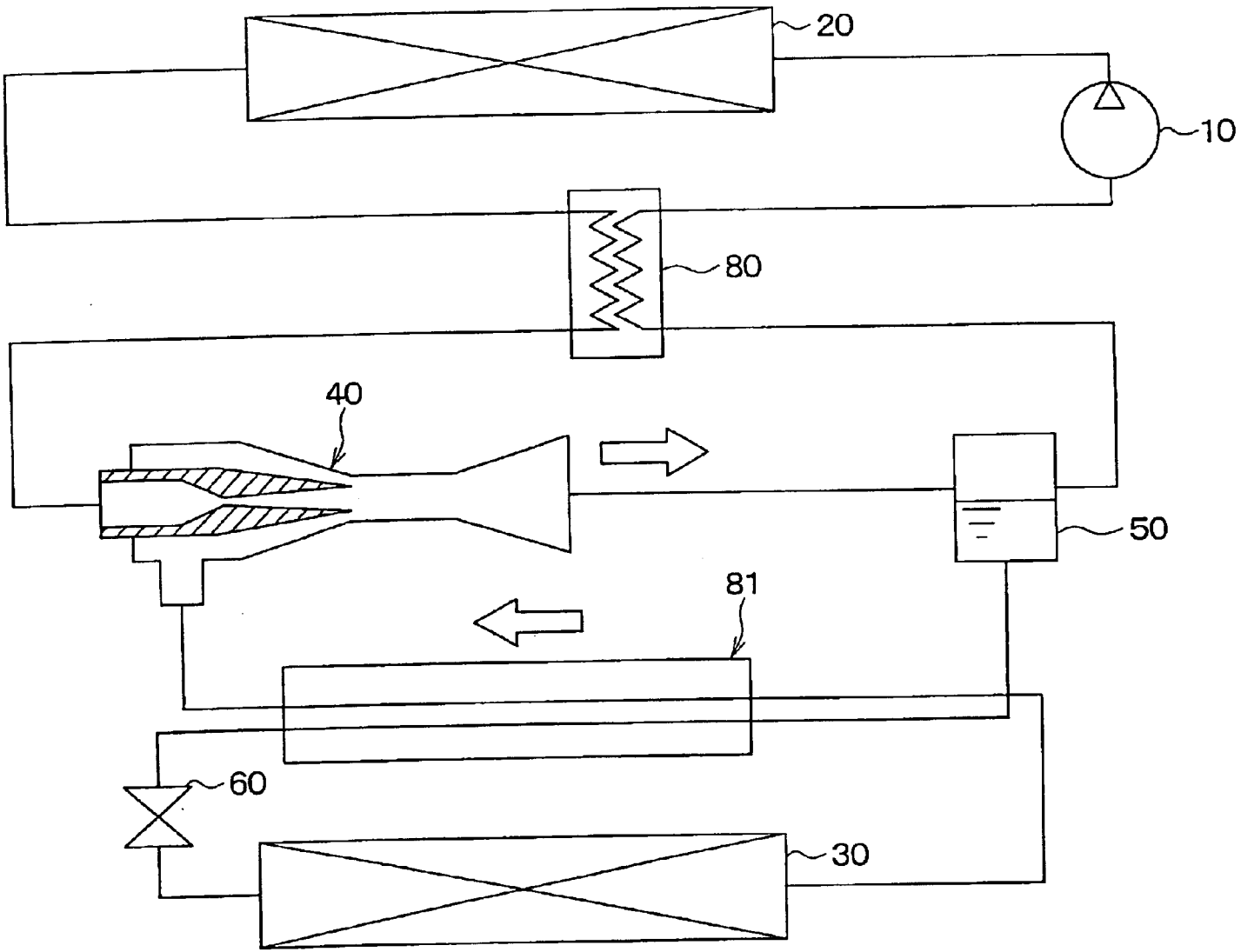
FIG. 7 is a schematic diagram showing an ejector cycle according to a second embodiment of the present invention.

In the second embodiment shown in FIG. 7, a heat exchanger 81 is provided to perform heat-exchange between refrigerant flowing from the gas-liquid separator 50 to the evaporator 30 and refrigerant sucked from the evaporator 30 into the ejector 40. In this case, the throttle 60 is provided in a refrigerant outlet side of the heat exchanger 81, at a position before being introduced into the evaporator 30. According to the second embodiment of the present invention, refrigerant flowing from the gas-liquid separator 50 toward the evaporator 30 can be cooled by low-temperature refrigerant flowing from the evaporator 30 into the ejector 40. Therefore, the refrigerant flowing into the evaporator 30 from the gas-liquid separator 50 can be approximated in a single-phase liquid refrigerant.

In the second embodiment, other parts are similar to those of the above-described first embodiment. Thus, temperature deviation can be made small while cooling capacity (heat-absorbing capacity) of the evaporator 30 can be improved.

(Third Embodiment)

Figure 8:
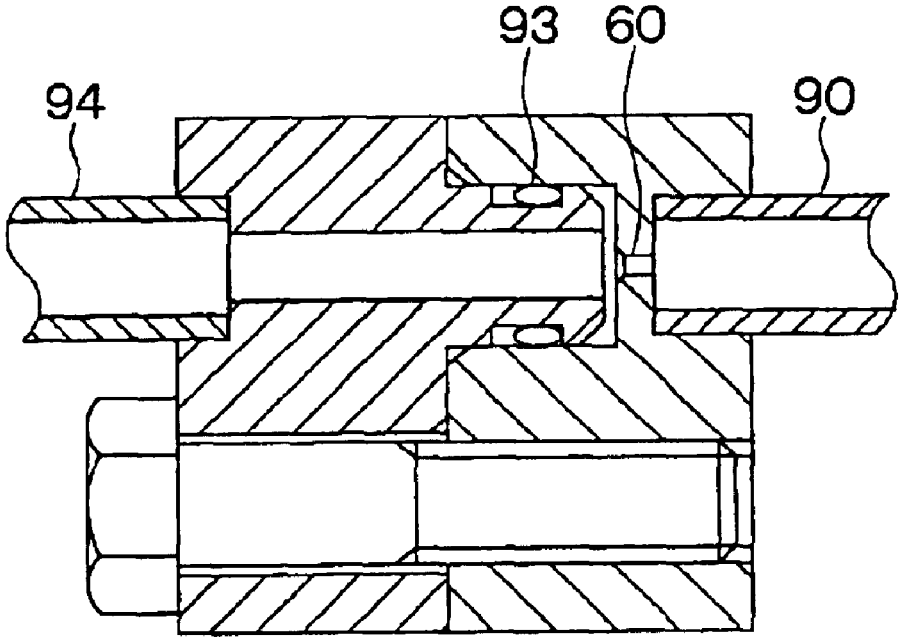
FIG. 8 is a schematic view showing a structure of a throttle according to a third embodiment of the present invention.

In the third embodiment, as shown in FIG. 8, a throttle 60 is provided in a connecting portion between the interior refrigerant pipe 90 and an exterior refrigerant pipe 94. The interior refrigerant pipe 90 is connected to the evaporator 30, and is provided in the passenger compartment. On the other hand, the exterior refrigerant pipe 94 is connected to the gas-liquid separator 50, and is provided in the engine compartment. In the third embodiment, the shape of the throttle 60 and the shape of the connection portion between the interior refrigerant pipe 90 and the exterior refrigerant pipe 94 can be suitably changed. Further, the throttle 60 is preferably provided in the passenger compartment or in a partition wall for partitioning the passenger compartment and the engine compartment. However, the throttle 60 can be provided in the engine compartment outside the passenger compartment at a position near the evaporator 30.

Although the present invention has been fully described in connection with the preferred embodiments thereof with reference to the accompanying drawings, it is to be noted that various changes and modifications will become apparent to those skilled in the art.

For example, in the above embodiment, two core portions are provided serially with respect to the air flow direction, and the refrigerant outlet 33*b* is provided on the lower header tank 33. However, the structure of the evaporator 30 is not limited to that of described above. For example, the evaporator 30 can have one core portion in the air flow direction. Besides, the evaporator 30 can have refrigerant outlet 33*b* on its upper side.

The throttle 60 is not limited to a fixed throttle such as an orifice and a capillary tube used in this embodiment. As the throttle 60, a thermal expansion valve or a variable control valve can be used. The thermal expansion valve variably controls its throttle degree, so that a super heat degree of the refrigerant at an outlet of the evaporator 30 becomes a predetermined degree.

The nozzle 41 of the ejector 40 is not limited to the Laval nozzle adopted in this embodiment. For example, a tapered nozzle or the like can be used for the nozzle 41 of the ejector 40.

Further, the ejector cycle of the present invention can be used for an apparatus other than the vehicle air conditioner.

Such changes and modifications are to be understood as being within the scope of the present invention as defined by the appended claims.

What is claimed is:

1. An ejector cycle comprising:

a compressor for compressing refrigerant;

a high-pressure heat exchanger disposed outside of a compartment, for radiating heat of high-pressure refrigerant discharged from the compressor;

a low-pressure heat exchanger disposed in the compartment for evaporating low-pressure refrigerant after being decompressed;

an ejector including a nozzle for decompressing and expanding high-pressure refrigerant flowing from the high-pressure heat exchanger, the ejector sucking gas refrigerant evaporated in the low-pressure heat exchanger by using a refrigerant flow jetted from the nozzle, and increasing a pressure of the refrigerant to be sucked to the compressor;

a gas-liquid separator for separating refrigerant discharged from the ejector into gas refrigerant and liquid refrigerant, the gas-liquid separator having a gas refrigerant outlet connected to a suction port of the compressor, and a liquid refrigerant outlet connected with the low-pressure heat exchanger; and a throttle for decompressing refrigerant flowing from the gas-liquid separator into the low-pressure heat exchanger, wherein the throttle is provided in the compartment.

2. The ejector cycle according to claim 1, further comprising:

an interior refrigerant pipe disposed in the compartment to be connected to the low-pressure heat exchanger; and an exterior refrigerant pipe disposed outside the compartment to be connected to the gas-liquid separator, wherein:

the interior refrigerant pipe and exterior refrigerant pipe are connected to a connection portion; and the throttle is disposed in the connection portion.

3. The ejector cycle according to claim 2, wherein the throttle is an orifice provided in the connection portion.

4. The refrigerant cycle according to claim 1, further comprising:

an interior refrigerant pipe that is connected to the low-pressure heat exchanger at a connection portion, wherein the throttle is provided in the connection portion between the interior refrigerant pipe and the low-pressure heat exchanger.

5. The ejector cycle according to claim 4, wherein the throttle is an orifice provided in the connection portion.

6. The ejector cycle according to claim 1, wherein:

the low-pressure heat exchanger is connected to the gas-liquid separator through a refrigerant pipe; and the throttle is disposed in the refrigerant pipe adjacent to the low-pressure heat exchanger.

7. The ejector cycle according to claim 1, further comprising an additional heat exchanger that is disposed to perform heat exchange between refrigerant flowing from the gas-liquid separator to the low-pressure heat exchanger and refrigerant to be sucked to the ejector from the low-pressure heat exchanger, wherein the throttle is disposed in a refrigerant passage through which liquid refrigerant is introduced from the gas-liquid separator to an inlet of the low-pressure heat exchanger, between an outlet of the additional heat exchanger and the inlet of the low-pressure heat exchanger.

8. The ejector cycle according to claim 1, wherein:

the low-pressure heat exchanger includes a plurality of tubes extending substantially vertically, an upper header tank connected to upper ends of the tubes to communicate with the tubes, and a lower header tank connected to lower ends of the tubes to communicate with the tubes;

the low-pressure heat exchanger has a refrigerant inlet from which refrigerant is introduced into the low-pressure heat exchanger; and the refrigerant inlet is provided in the lower header tank.

9. An ejector cycle comprising:

a compressor for compressing refrigerant;

a high-pressure heat exchanger disposed outside of a compartment, for radiating heat of high-pressure refrigerant discharged from the compressor;

a low-pressure heat exchanger disposed in the compartment for evaporating low-pressure refrigerant after being decompressed;

an ejector including a nozzle for decompressing and expanding high-pressure refrigerant flowing from the high-pressure heat exchanger, the ejector sucking gas refrigerant evaporated in the low-pressure heat exchanger by using a refrigerant flow jetted from the nozzle, and increasing a pressure of refrigerant to be sucked into the compressor; and a gas-liquid separator for separating refrigerant discharged from the ejector into gas refrigerant and liquid refrigerant, the gas-liquid separator having a gas refrigerant outlet connected to a suction port of the compressor, and a liquid refrigerant outlet connected with the low-pressure heat exchanger, wherein:

the low-pressure heat exchanger includes a plurality of tubes extending substantially vertically, an upper header tank connected to upper ends of the tubes to communicate with the tubes, and a lower header tank connected to lower ends of the tubes to communicate with the tubes;

the low-pressure heat exchanger has a refrigerant inlet from which refrigerant is introduced into the low-pressure heat exchanger; and the refrigerant inlet is provided in the lower header tank.

10. An arrangement structure of an ejector cycle in a vehicle having a passenger compartment and an engine compartment partitioned from each other, the arrangement structure comprising:

a compressor disposed in the engine compartment, for compressing refrigerant;

a high-pressure heat exchanger disposed in the engine compartment, for radiating heat of high-pressure refrigerant discharged from the compressor;

a low-pressure heat exchanger disposed in the passenger compartment, for evaporating low-pressure refrigerant after being decompressed;

an ejector disposed in the engine compartment, which includes a nozzle for decompressing and expanding high-pressure refrigerant flowing from the high-pressure heat exchanger, the ejector sucking gas refrigerant evaporated in the low-pressure heat exchanger by using a refrigerant flow jetted from the nozzle, and increasing a pressure of refrigerant to be sucked to the compressor;

a gas-liquid separator disposed in the engine compartment, for separating refrigerant discharged from the ejector into gas refrigerant and liquid refrigerant, the gas-liquid separator having a gas refrigerant outlet connected to a suction port of the compressor, and a liquid refrigerant outlet connected with the low-pressure heat exchanger; and a throttle for decompressing refrigerant flowing from the gas-liquid separator into the low-pressure heat exchanger, wherein the throttle is provided in the passenger compartment.

11. The arrangement structure according to claim 10, further comprising an interior refrigerant pipe that is connected to the low-pressure heat exchanger at a connection portion in the passenger compartment, wherein the throttle is provided in the connection portion between the interior refrigerant pipe and the low-pressure heat exchanger.

12. The ejector cycle according to claim 10, further comprising:

an interior refrigerant pipe disposed in the passenger compartment to be connected to the low-pressure heat exchanger; and an exterior refrigerant pipe disposed in the engine compartment to be connected to the gas-liquid separator, wherein the interior refrigerant pipe and the exterior refrigerant pipe are connected to a connection portion in the passenger compartment, and the throttle is disposed in the connection portion.

* * * * *